US007001292B1

(12) United States Patent
Rappaport

(10) Patent No.: US 7,001,292 B1
(45) Date of Patent: Feb. 21, 2006

(54) SAFETY DART WITH WOVEN MESH FLEXIBLE TAIL

(76) Inventor: Mark Rappaport, 1817 Aston Ave., Suite 103, Carlsbad, CA (US) 92008-7339

( * ) Notice: Subject to any disclaimer, the term of this patent is extended or adjusted under 35 U.S.C. 154(b) by 0 days.

(21) Appl. No.: 10/957,762

(22) Filed: Oct. 4, 2004

(51) Int. Cl.
*A63B 65/02* (2006.01)

(52) U.S. Cl. ..... 473/570; 473/574; 473/578; 473/586

(58) Field of Classification Search ..... 473/570, 473/572, 573, 574, 578, 585, 586
See application file for complete search history.

(56) References Cited

U.S. PATENT DOCUMENTS 1,261,957 A * 4/1918 Pewther ..... 473/585
2,011,749 A * 8/1935 Brading ..... 473/572
2,477,531 A * 7/1949 Volman ..... 473/570
2,665,911 A * 1/1954 Shore ..... 473/570
3,997,162 A * 12/1976 Scullin ..... 273/348.3
4,230,322 A 10/1980 Bottelsen
4,842,285 A 6/1989 Farler
5,118,117 A 6/1992 Denen
5,642,887 A 7/1997 Orav
5,775,694 A 7/1998 Jonsson
6,248,033 B1 6/2001 Lowy
6,267,698 B1 7/2001 Orav
6,533,688 B1 3/2003 Huang

* cited by examiner

*Primary Examiner*—John A. Ricci
(74) *Attorney, Agent, or Firm*—Dilworth & Barrese, LLP

(57) ABSTRACT

Disclosed herein is a safety, blunt end dart having a head of frusto-conical shape having first and second ends, with the first end being of a larger diameter than the second end, and the first end includes a magnet, and a longer flexible tail is fixedly and permanently secured to the second end.

7 Claims, 4 Drawing Sheets

SAFETY DART WITH WOVEN MESH FLEXIBLE TAIL

This invention relates generally to construction of toys, and more particularly to darts for use in playing the game of darts.

Dart tips are generally constructed one of two ways: as a standard pointed-tip dart or as a safety, non-pointed tip darts.

It is well recognized that darts having a pointed tip are generally inappropriate for use by children. Examples of pointed, or sharp, tip darts is provided in U.S. Pat. No. 4,230,322, entitled "No Bounce Dart", U.S. Pat. No. 6,533,688, entitled "Dart With Rotary Flight And Light Means", U.S. Pat. No. 5,118,117, entitled "Recreational Dart", U.S. Pat. No. 6,248,033, entitled "Darts For The Game Of Darts", and U.S. Pat. No. 4,842,285, entitled "Anti-Bounce-Out Dart", the disclosure of each of which is incorporated herein by reference.

Examples of a safety, non-pointed tip darts are magnetic tip darts and suction cup tip darts, as described by U.S. Pat. No. 6,267,698, entitled "Soft Tip Game Dart", and U.S. Pat. No. 5,775,694, entitled "Dart Game With Blunt Dart Having Magnet Surrounded By Non-Magnetic Sleeve And Board Including Magnetic Material", the disclosure of which is incorporated herein by reference. The '694 patent describes providing a standard dart body with a high-energy magnet at its tip to allow the electromagnetic input that results from the dart striking the dartboard to register the regions of the board that is struck.

To provide a participant in the game of darts with a competitive advantage, numerous efforts have been made to improve the flight of darts and to reduce "bounce-out" after a dart strikes the dartboard. One such technique is described in U.S. Pat. No. 5,642,887, entitled "Game Dart With Retractable Flight Section", the contents of which are incorporated herein by reference.

Such conventional techniques, however, fail to provide a dart that is safe, that provides acceptable flight characteristics, and that is durable and economical to produce. Accordingly, the dart of the present invention has been developed to provide a dart that is durable, is economical to produce, and provides superior flight characteristics without compromising its essential safe nature.

SUMMARY OF THE INVENTION

To overcome the deficiencies of conventional darts, the present invention provides a dart having a lightweight, flexible tail that makes up a majority of the length of the dart, thereby improving safety.

The dart of the present invention includes a flexible tail made from an interwoven mesh to significantly reduce the weight of the tail and to provide the dart with superior flight characteristics. As constructed in the manner described below, the dart can be thrown in a knife-like fashion, i.e. with the thrower grasping the tail rather than the head or body. The dart is self-righting and the unique construction allows the tail to self-correct during flight. In addition to being light in weight, the mesh performs a shock absorbing function to reduce bounce-out.

The present invention provides a dart made by combining a head having first and second ends, with the first end being of a larger diameter than the second end, and the first end includes a magnet; with a flexible tail fixedly and permanently secured to the second end, wherein the flexible tail is formed from a tube of woven material.

The present invention further provides a method of constructing a blunt end safety dart by weaving a fiber to create a flexible tube; by constructing a flexible tail by inwardly folding the flexible tube to create first and second ends, wherein all exposed ends of the fiber are placed at the first end and only a continuous weave appears at the second end. A dart head is constructed by affixing a magnet in a first end thereof and providing a hole in a second, opposite end; and by affixing, in the second end of the head, the first end of the folded flexible tube, wherein the flexible tail makes up a majority of the overall length of the dart.

BRIEF DESCRIPTION OF THE DRAWINGS

For a better understanding of the invention as well as other objects and further features thereof, reference is made to the following detailed description to be read in conjunction with the accompanying drawings, wherein.

DESCRIPTION OF THE PREFERRED EMBODIMENTS

The following detailed description of preferred embodiments of the invention is made with reference to the accompanying drawings. In describing the invention, explanation of related functions or constructions known in the art is omitted for the sake of clearness in understanding the concept of the invention, to avoid obscuring the description of the invention with unnecessary detail:

In a preferred embodiment, a dart 100 is constructed with a dart head 102 and tail 104. The tail 104 is of a conical, tapered shape formed from a mesh tube to provide a flexible, permanently affixed tail, as shown in FIGS. 1–4.

The tail 104 preferably is constructed from a tube of a loosely woven material, such as a nylon mesh. The interlacing strands are weaved or braided in a manner to construct a tube that resembles a Chinese finger trap. To prevent fraying, it is preferable to utilize a coated material. In a preferred embodiment, a nylon mesh is utilized. It will be recognized that other materials can be used.

Figure 1:
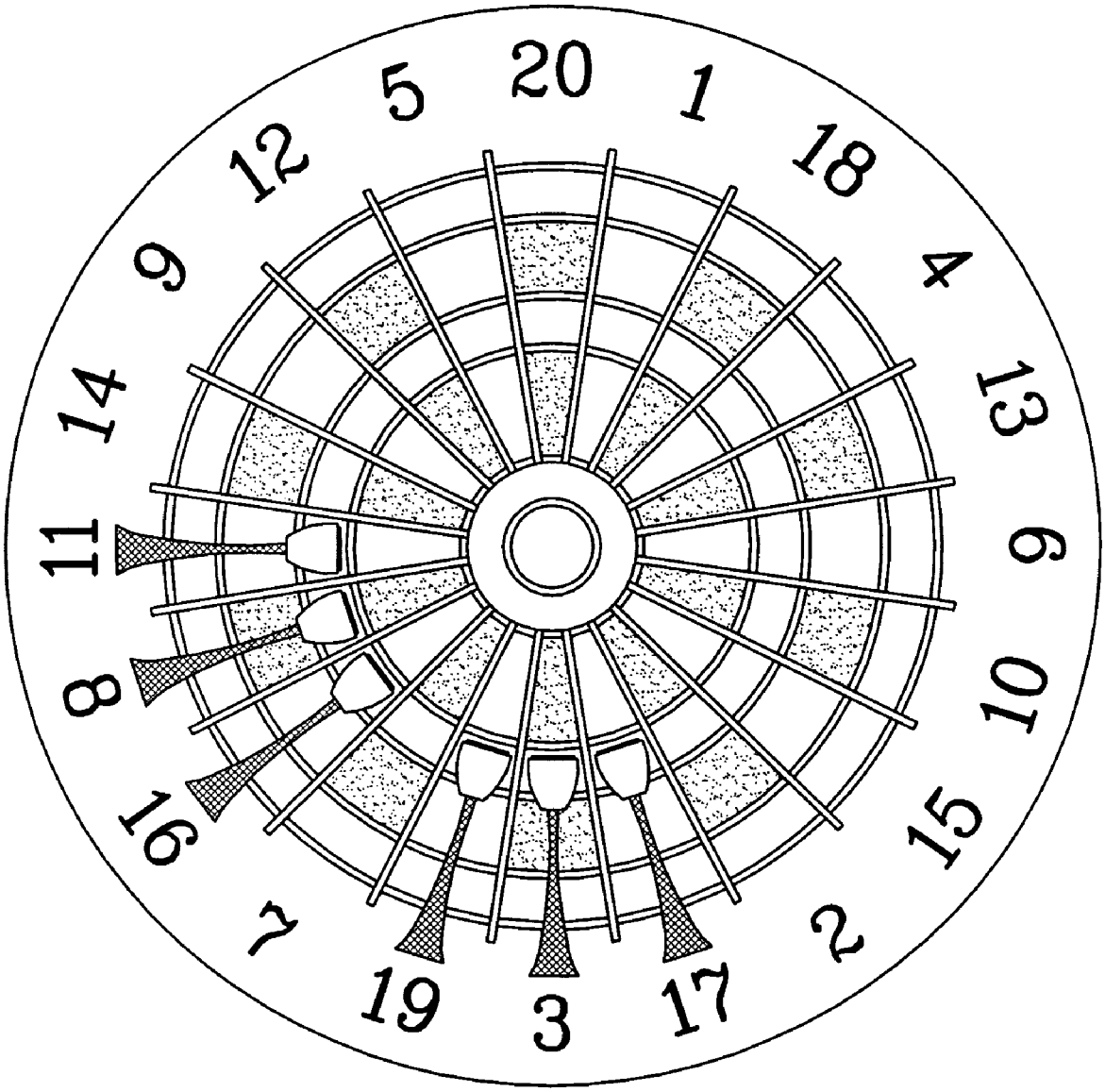
FIG. 1 is a view of several of the inventive darts packaged with a dartboard.
Figure 2:
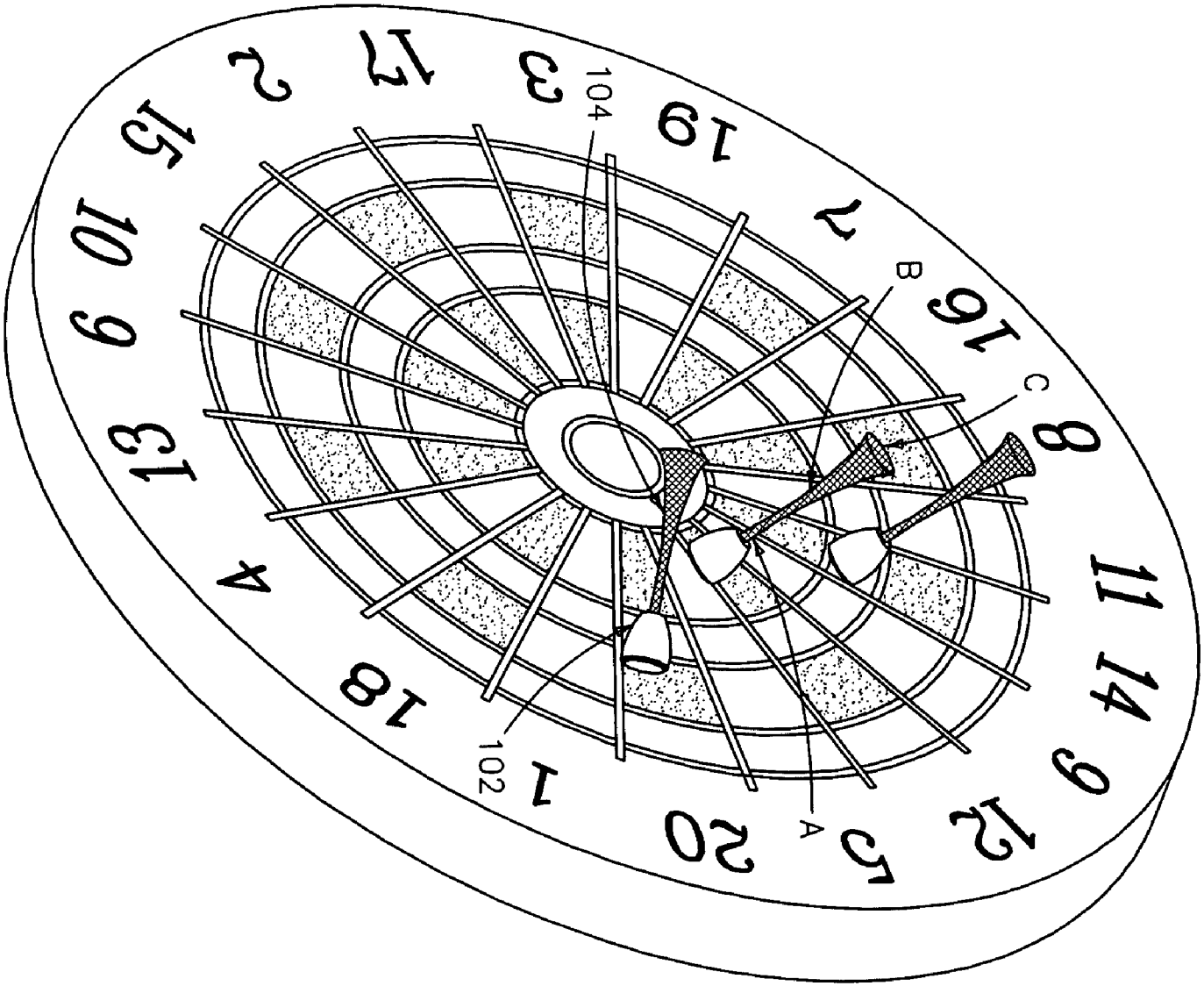
FIG. 2 shows several of the inventive darts magnetically affixed to the dartboard, with one dart manually turned on its side to show a magnet in the head of the FIG. 3 is a close-up view of two of the inventive darts, with the tail of one dart being manually deflected and the with the tail of the other dart having been deformed by pushing the tail inward from a distal end toward the dart body.

As shown in FIG. 2, the tail 104 has an end A proximal to the head 102, a middle portion B, and a distal end C. The mesh at the proximal end A is pulled tighter than at middle portion B, thereby reducing the diameter of the tail 104 proximal end A thereby also providing greater stiffness at proximal end A.

Distal end C has the largest relative diameter, created by allowing the mesh to expand. The expanded mesh has larger gap between the weave, which increases air drag at distal end C and providing a self-righting operation. Such construction eliminates the need for fins, which are necessary on conventional darts.

In a preferred embodiment, the mesh tube is inwardly folded, thereby creating a double thickness of the tube throughout, which advantageously increases the stiffness of the tail 104. The lightweight of the mesh allows the double thickness to be utilized without adding an undesirable amount of excess weight. Utilization of the woven mesh to construct the tail 104 creates a hole in the tail 104, with the hole extending longitudinally from distal end C through middle portion B to proximal end A.

Figure 3:
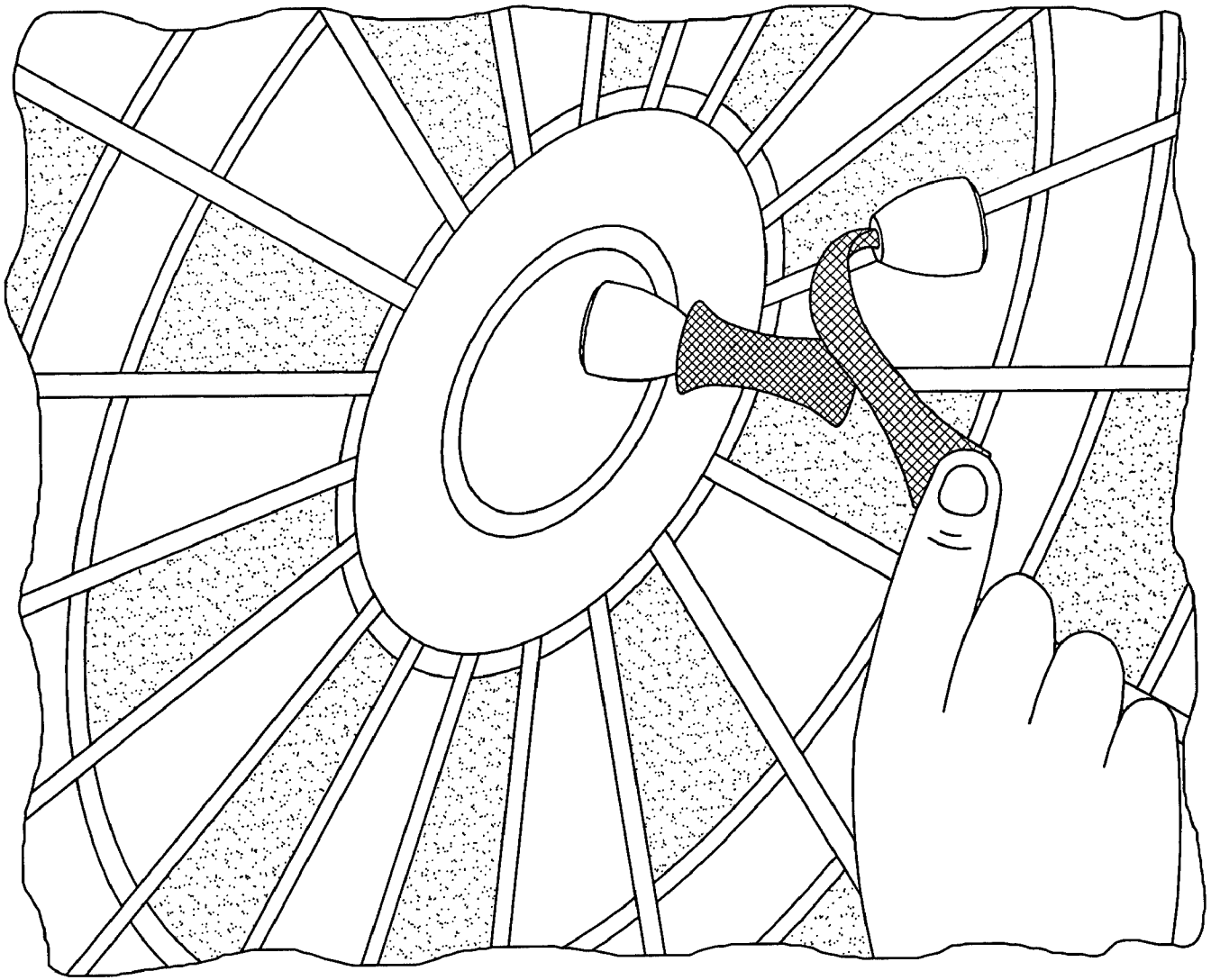
Figure 4:
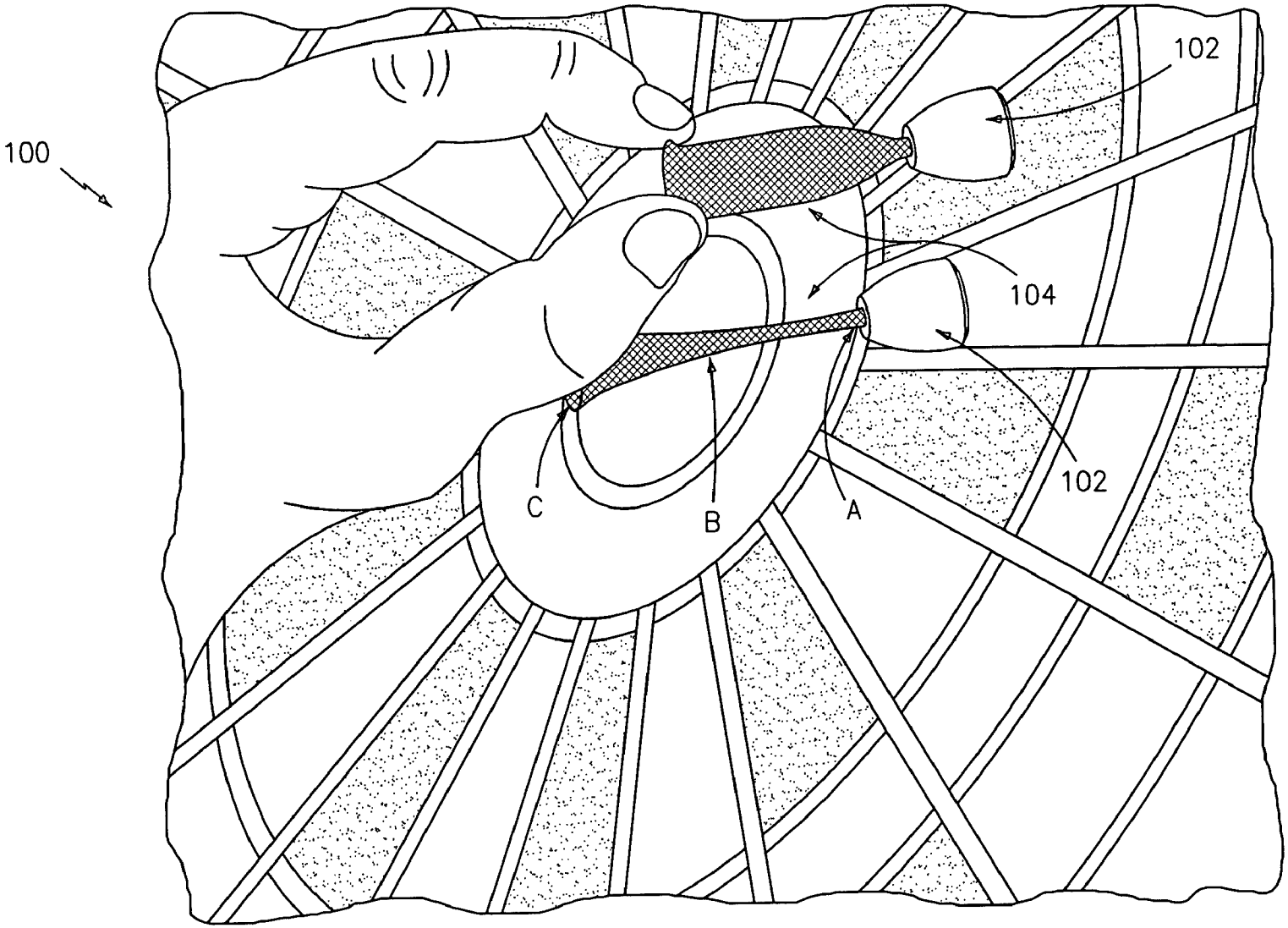
FIG. 4 is another close-up view of two inventive darts, with the tail of one dart manually compressed toward the dart body.

As shown in the close-up views FIGS. 3 and 4, the tail 104 can be deflected or deformed by manipulation. Similar deflection will occur on impact, thereby providing a safer dart. Once the deflecting/deforming force is removed, the tail 104 generally returns to its original position.

The dart head 102 is preferably made of rigid plastic or like material, and as also shown in FIGS. 1–4, is preferably provided etched around its exterior to allow the user to maintain an improved grip thereon.

The invention is not limited to the disclosed preferred embodiment, and should be construed to cover all such alternatives, modifications and equivalents as defined in the appended claims.

What is claimed is:

1. In a dart, a combination of:

a head having first and second ends, with the first end being of a larger diameter than the second end, and the first end includes a magnet; and a flexible tail fixedly and permanently secured to the second end.

2. The dart of claim 1, wherein the flexible tail and the head are each frusto-conical in shape, with adjoining respective smaller diameter ends.

3. The dart of claim 2, wherein the flexible tail is formed from a tube of woven material.

4. The dart of claim 1, wherein the flexible tail has a frusto-conical shape, with a smaller end of the tail secured to the dart head.

5. The dart of claim 4, wherein the tail has a larger diameter distal end formed by affixing one end of a tube of woven material to the dart head and folding an other end of the tube within the tube.

6. A dart comprising:

a head having means for securing to a ferric dartboard; and a tail constructed from a woven mesh material that is flexible throughout its length, wherein the flexible tail is lighter in weight than the head and makes up a majority of a length of the head and tail.

7. A method of constructing a blunt end safety dart comprising:

weaving a fiber to create a flexible tube;

constructing a flexible tail by inwardly folding the flexible tube to create first and second ends, with all exposed ends of the fiber being placed at the first end and only a continuous weave appearing at the second end;

constructing a head by affixing a magnet in a first end thereof and providing a hole in a second, opposite end; and affixing, in the second end of the head, the first end of the folded flexible tube, wherein the flexible tail makes up a majority of the overall length of the dart.

* * * * *